United States Patent [19]

DeVane

[11] Patent Number: 4,667,770

[45] Date of Patent: May 26, 1987

[54] SOUND ATTENUATOR

[76] Inventor: Harry M. DeVane, 1559 Pine St., Oxnard, Calif. 93030

[21] Appl. No.: 914,274

[22] Filed: Oct. 2, 1986

[51] Int. Cl.[4] ..... F01N 1/12

[52] U.S. Cl. ..... 181/280; 181/243; 181/252

[58] Field of Search ..... 181/243, 244, 252, 256, 181/279, 280

[56] References Cited

U.S. PATENT DOCUMENTS 3,235,003 2/1966 Smith ..... 181/256 X 3,696,883 10/1972 DeVane ..... 181/280

4,421,202 12/1983 Hoy ..... 181/244 X

*Primary Examiner*—Benjamin R. Fuller

*Attorney, Agent, or Firm*—Jack C. Munro

[57] ABSTRACT

A sound attenuator for use in a rigid walled duct through which gas is to flow which comprises a cylindrical hollow shell within which is mounted a helical, sound absorbing, vane assembly. The interior of the wall of the shell is formed of a metallic wire screening. The shell itself is formed of a soft fiberglass mat for sound absorbing purposes. A similar fiberglass mat is included within each vane. Also, each vane includes a layer of lead.

9 Claims, 7 Drawing Figures

SOUND ATTENUATOR

BACKGROUND OF THE INVENTION

The field of this invention relates to a sound absorbing apparatus to diminish the level of sound emitted from a specific source and more particularly to a sound attenuator for a gas flow duct to diminish the sound that is produced by the apparatus that is producing the air movement through the duct.

The moving of a gas through a duct system is exceedingly common within industry. A typical gas would be air. A common form of an apparatus to move air through the duct system would be a fan or blower. The basic construction of a blower would comprise a shaft upon which are mounted fan blades. Rotation of the blades results in air movement forward of the blades. This air movement is directed by a duct to a particular location.

Because of the physical size of the blowers, it is common that a substantial amount of noise will be generated in the operation of the blower. To any individual working in close proximity to the blower, the noise generated not only can be annoying, but actually can be damaging to one's ears after a period of time.

It has been found that, like the gas itself, the noise is directed downstream of the duct. It has been known in the past to insert some type of device within the duct to mute sound within the duct, yet permit the air to flow through the duct in a substantially unrestricted manner. There is a need to constantly improve on such devices to decrease as much as possible the sound within the duct. The structure of the present invention is directed to such a device that improves upon the efficiency of prior art sound absorbing apparatuses.

SUMMARY OF THE INVENTION

The structure of the present invention takes the form of a cylindrical shell which has an internal open-ended compartment. Within the internal open-ended compartment is mounted a helically wound sound absorbing vane assembly. Each vane of the vane assembly is constructed of a strip of lead, in sheet material form, upon which has been adhesively secured on each side thereof a fiberglass matting material to absorb sound. This vane assembly is attached at its periphery to a cylindrical wire frame. This wire frame is fixedly mounted to the interior wall of the shell. The construction of the shell will also be of a fiberglass mat which is encased in a netting.

One of the primary objectives of the present invention is to provide a sound attenuating device which can be merely inserted within a gas flow duct and thereby absorb sound without requiring any modification of the duct itself eliminating the need for utilizing a fastener arrangement between the duct and the sound attenuator.

Another objective of the present invention is to provide for a sound attenuator structure which can be slightly deformed from a circular configuration to assume a slightly out-of-round configuration to then be installed within slightly out-of-round ducts.

Another objective of the present invention is to construct a sound attenuator that can be manufactured relatively inexpensively and therefore can be sold to the ultimate user at a relatively inexpensive price.

DETAILED DESCRIPTION OF THE SHOWN EMBODIMENT

Figure 4:
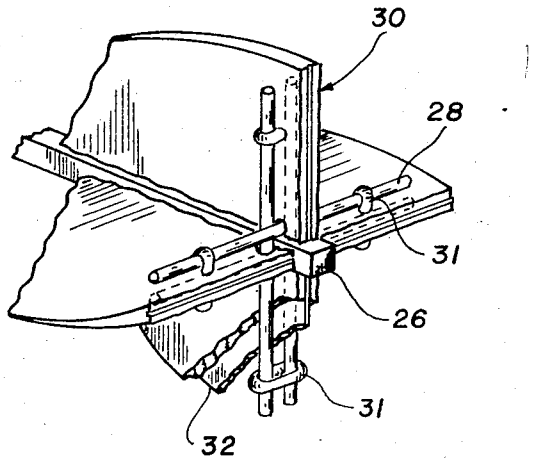
FIG. 4 is a segmental, isometric view of the helical vane assembly utilized in conjunction with the sound attenuator of the present invention clearly showing the construction of the vane assembly.

The structure of the shown embodiment is designed to be located in a gas flow duct 10. The typical gas flow duct 10 is basically cylindrical and is formed of a thin sheet material wall which encloses a gas passage 12. Gas, such as air, will normally be conducted at a high velocity through the passage 12 from a source such as a blower (not shown). The passage 12 not only functions to direct the gas from the source to a particular location (not shown) but also functions to channel noise which is emitted from the blower. This channeling of noise is an undesirable feature inherent with any blower.

The primary source of the noise is from the blower with very little noise being emitted by the actual movement of the gas itself. The sound attenuator 14 of this invention is designed to be located within the passage 12 and is to absorb some of the noise within the passage 12 yet permitting passage of gas through the passage 12 with a minimum amount of restriction.

Although the duct 10 shown is cylindrical, and most such ducts are cylindrical, it is considered to be within the scope of this invention that non-cylindrical ducts 10 could be utilized. In such an instance, the cross-sectional configuration of the sound attenuator 14 of this invention will be modified to correspond with the configuration of the duct 10. If the duct 10 is slightly out-of-round, the sound attenuator 14 can be slightly deformed to assume this out-of-round configuration when the sound attenuator 14 is inserted within the passage 12.

Normally the sound attenuator 14 will be constructed to be of established lengths. Common lengths would be one-third or one-half of a meter or whatever length is desired.

In order to diminish the noise to a tolerable level, it may require the utilization of more than one in number of the sound attenuators 14. In such an instance a single sound attenuator 14 will be inserted within the passage 12 and, if the noise is not diminished to a tolerable level, a second sound attenuator 14 would be then also placed within the passage 12. If the noise is not reduced to a tolerable level at this time, possibly even a third, fourth or fifth sound attenuator 14 will be inserted within the duct in line with the previously inserted sound attenuators 14.

The sound attenuator 14 is constructed of an outer shell 16. Shell 16 is cylindrical in configuration and has a through opening forming a compartment 18 located centrally therein. The shell 16 is formed of a soft fibrous mat 20 usually of fiberglass which is encased within a fiberglass netting 22. The netting 22 is substantially open resembling screening. The fiberglass mat 20 includes a mass of fibers which are packed together. For safety purposes the fiberglas fibers have been coated with a plastic so as to prevent dispersement of any portion of the mat in air during construction of the sound attenuator 14 or during its usage. One reason for fiberglass being selected is that it has desirable features since it is able to withstand a substantial amount of heat without incurring deterioration. Also, fiberglass is resistant to chemicals. It is to be kept in mind that the sound attenuator 14 of this invention is frequently used in conjunction with gases other than air and these gases may be toxic.

In order to provide body strength to the shell 16, there is mounted within the compartment 18 a tubular frame 24 which is fixedly secured to the wall of the compartment 18. The frame 24 is shown to be constructed of metallic wire which is substantially open. However, it is considered to be within the scope of this invention that material other than metal could be utilized to form the frame 24.

Fixedly secured by adhesive or other similar type of securing arrangement there is mounted a helical vane assembly. This helical vane assembly utilizes an elongated, straight rigid bar 26 which is mounted substantially along the center-line of compartment 18. Fixedly secured to the bar 26 are a plurality of rods 28. These rods 28 can be welded directly to elongated bar 26. The rods 28 are divided into a series of pairs with one rod 28 being mounted on one side of the bar 26 and another rod 28 being mounted on the opposite side of the bar 26. These rods are mounted in pairs parallel to each other assuming a slight spacing. The bar 26 is square in cross-section. Therefore, because opposite sides of the bar 26 are parallel, mounting of the rods 28 to the sides of the bar naturally causes the rods 28 to assume the slightly spaced, parallel configuration.

Figure 5:
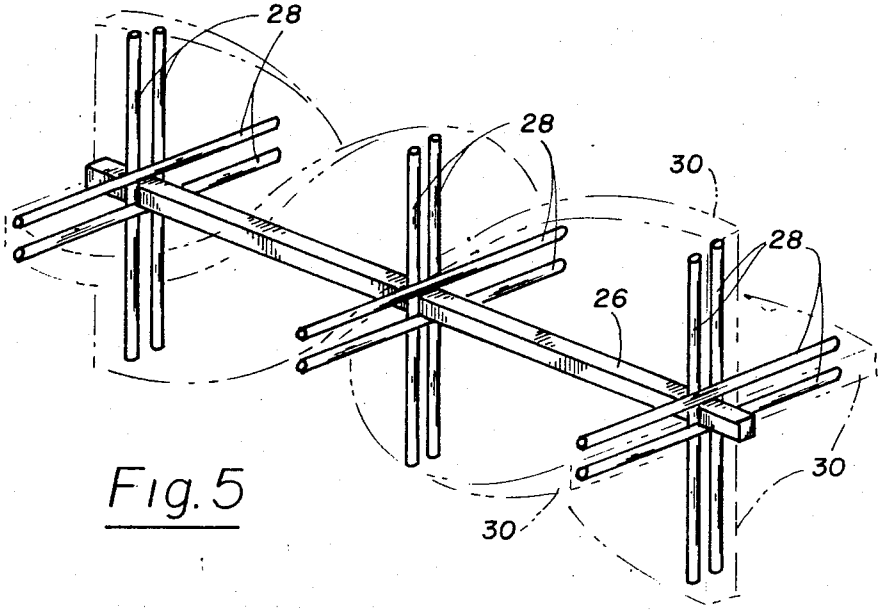
FIG. 5 is an isometric view of the supporting assembly for the helical vane arrangement utilized in conjunction with the sound attenuator of the present invention depicting the mounting thereon of the vanes in the helical pattern in phantom lines.

It is to be noted in referring to FIG. 5 that there are shown three sets of vertically oriented rods 28 with each set being substantially evenly spaced from each other. Also there is shown three sets of horizontally oriented pairs of rods 28. A horizontal pair of rods 28 abut against a pair of vertically oriented rods 28 to form a crossed configuration. It is to be noted that the length of the rods 28 are all identical.

The rods 28 are utilized as a mounting structure for vane members 30. The vane members 30 are identical to each other in construction and size. The width of each vane member 30 is approximately one-half the diameter of compartment 18. The length of each vane member is preselected so when installed in position will assume a length equal to the length of compartment 18.

Each vane member 30 is constructed of a centrally disposed sheet material lead panel 32. Adhesively secured to either side of this lead panel 32 is a layer of fiberglass matting 34. Covering the fiberglass matting 34 is a fiberglass netting 36. This netting 36 does not cover the edges of the vane member 30. The netting 36 is similar to the netting 22. The netting 36 is to be secured in place by stitching 38.

In order to prevent the air flow from separating the fiberglass matting 34 from the panel 32, the leading and trailing edges of each panel 30 is covered by a protective strip 40 which is either secured in place by adhesive or sewing.

Figure 1:
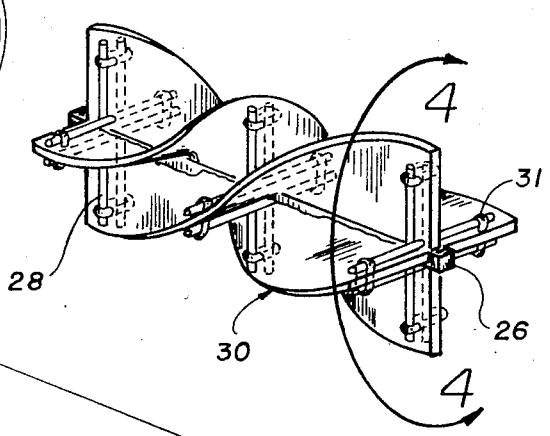
FIG. 1 is an exploded isometric view of the sound attenuator of the present invention showing its association with a gas flow duct.
Figure 1:
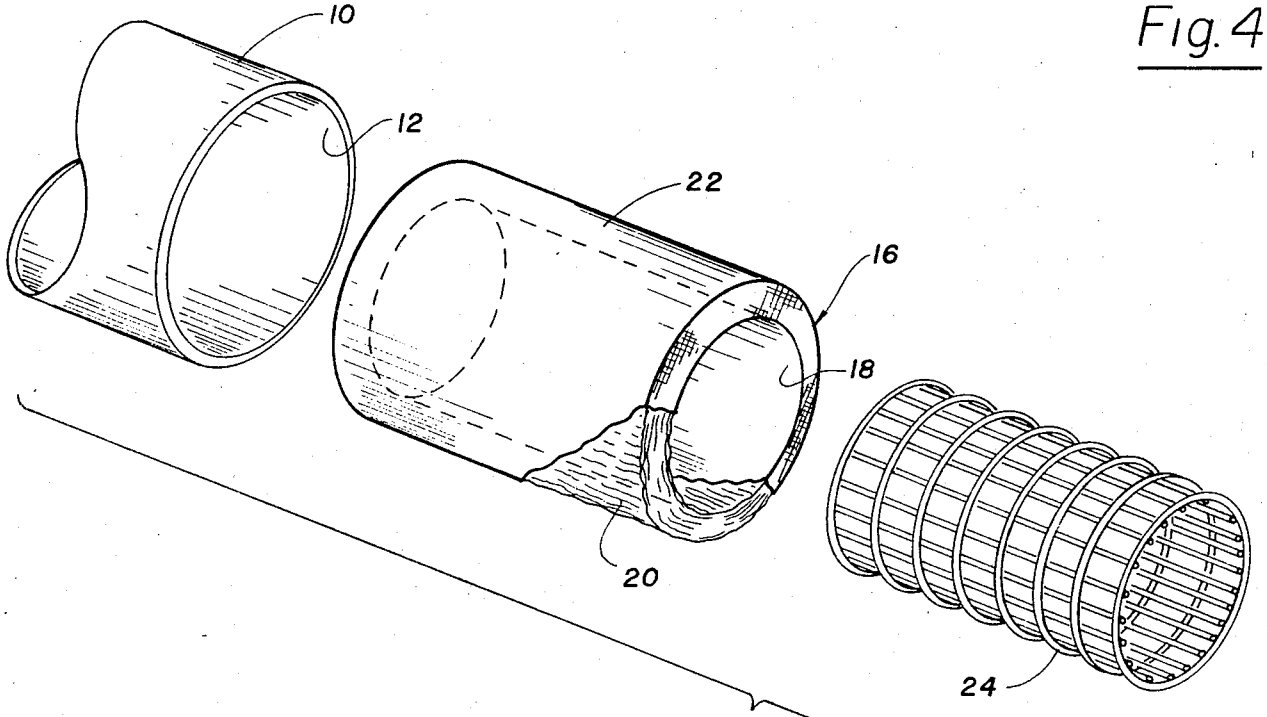
Figure 6:
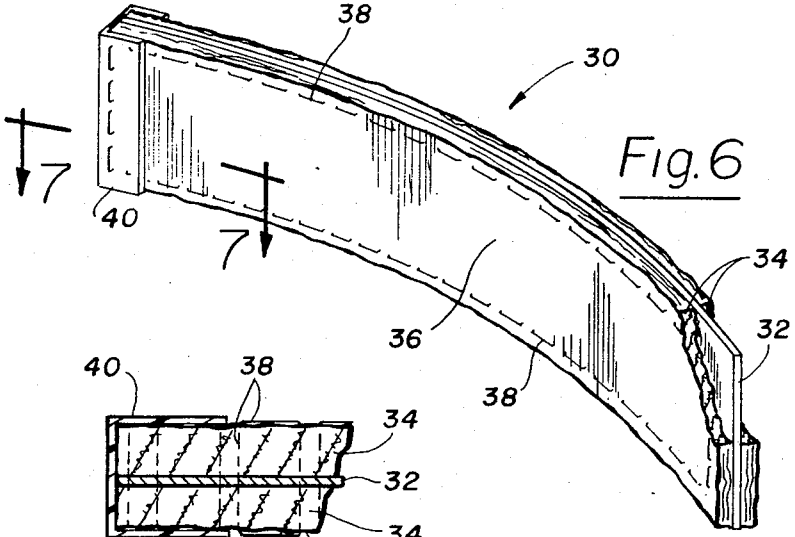
FIG. 6 is an isometric view of one of the vanes showing, partly in cross-section, the construction of the vane.
Figure 7:
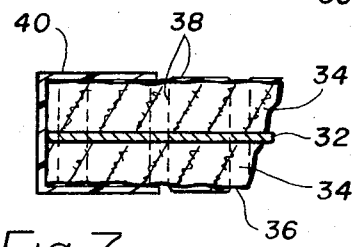
FIG. 7 is a cross sectional view through the vane of FIG. 6 taken along line 7—7 of FIG. 6.
Figure 2:
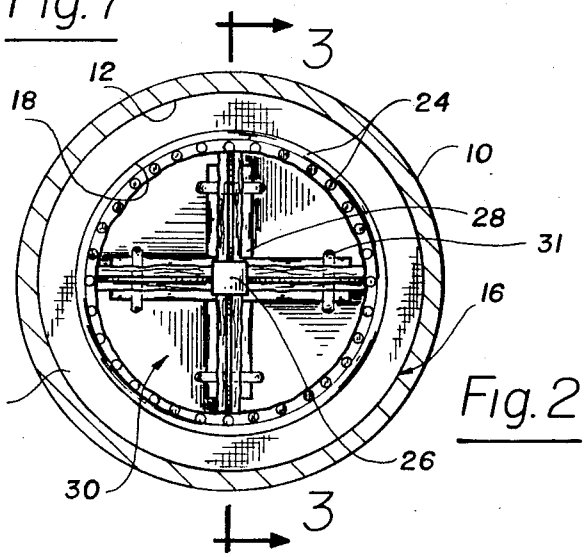
FIG. 2 is an end view of a gas flow duct within which has been mounted the sound attenuator of the present invention.
Figure 3:
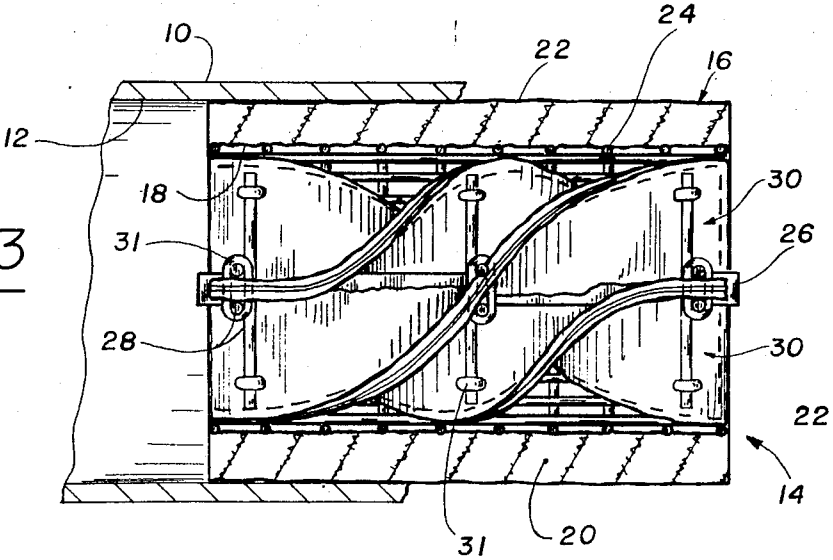
FIG. 3 is a longitudinal cross-sectional view of the sound attenuator of the present invention showing the sound attenuator installed within a duct.

Referring particularly to FIGS. 1 and 5 of the drawings, it can be seen that a vane member 30 is connected to the rearwardmost horizontal section of the rods 28, then is bent until the vane member is located between the next succeeding pair of rods which are positioned in a vertical manner. Then the member 30 is mounted between the rods 28 of the next succeeding pair that are located in a horizontal direction but opposite the horizontally positioned rods at the rearwardmost section of the bar 26. Thus it can be seen that the member 30 has assumed a helical configuration. There are four in number of members 30 so installed in conjunction with the rods 28 to form the configuration depicted in FIGS. 1 and 5. Because each of the vane members 30 includes the lead panel 32, the vane member 30 can be easily physically distorted to the desired helical configuration and the vane member 30 will remain in that position. Also, because utilizing of the lead panel 32, a desirable amount of overall rigidity is given to the vane members 30. Still further, the use of a lead panel 32 acts as a barrier to sound waves which is desirable. Each vane member 30 is secured in place to rods 28 by wire bands 31 which pass through the vane member 30.

The operation of the sound attenuator 14 of this invention is as follows. Let it be assumed that the sound attenuator 14 is mounted within passage 12 of a duct 10. As sound waves are conducted along the passage 12 (along with the flow of gas), the sound waves come into contact with vane members 30. Sound waves will tend to penetrate vane members 30 with the result that a certain amount of the sound will be absorbed by the fiberglass matting 34. Upon the sound waves encountering the barrier within the vane members, which constitutes the lead panel 32, the sound waves will be reflected back through the fiberglass mat 34. Again, this reflection causes a certain amount of the sound to be absorbed by the fiberglass mat 34. These reflected sound waves will then be caused to penetrate another vane member 30 with the sound absorption being repeated. This sound absorption will continue for the entire length of the sound attenuator 14. Any sound waves that are reflected radially will be conducted through frame member 24 into the shell 16 and hence a certain portion of the sound waves will be absorbed by the fiberglass mat 20. Upon the sound waves encountering the wall of the duct 10, these sound waves will again be reflected back through the mat 20 with a result that another portion of the sound is absorbed with the non-absorbed portion being directed back toward the vane members 30. It can thusly be seen that the sound waves are absorbed, reflected, absorbed, reflected, and so forth in order to maximize the attenuation of the sound.

It is apparent that the gas flowing through the passage 12 will be discharged from the downstream end of the sound attenuator 14 in a substantially unrestricted flow with the gas assuming four in number of paths with a slight tendency of the gas to swirl after being conducted through the helically oriented paths by the vane members 30.

What is claimed is:

1. A sound attenuator for use in a gas flow duct, said duct having a sheet material wall, said sound attenuator for diminishing the sound emitted into the ambient from the duct, said sound attenuator comprising:

an outer hollow shell constructed primarily of a soft material, said shell having an internal open-ended compartment, said shell to be located within said duct with said shell snugly abutting against the wall of said duct;

a tubular frame, said tubular frame being substantially rigid, said tubular frame being located within said shell against the wall of said shell; and a sound absorbing vane assembly mounted within said internal compartment, said vane assembly defining an elongated helical path.

2. The sound attenuator as defined within claim 1 wherein:

said soft material comprising a fiberglass encased netting.

3. The sound attenuator as defined in claim 1 wherein:

said tubular frame being substantially open.

4. The sound attenuator as defined in claim 3 wherein:

said tubular frame comprising a wire screen.

5. The sound attenuator as defined in claim 1 wherein:

said sound absorbing vane assembly comprising a plurality of separate vane members.

6. The sound attenuator as defined in claim 1 wherein said sound absorbing vane assembly comprises:

an elongated bar mounted substantially at the longitudinal center-line of said duct, a plurality of supports projecting laterally from said bar and spaced longitudinally there along, a vane member twisted about said bar and mounted on said supports to lie along a helical path, said vane member being constructed of a sound absorbing material, said sound absorbing material including a soft fibrous mat.

7. The sound attenuator as defined in claim 6 wherein:

said vane member also including a thin sheet material strip of lead, said fibrous mat comprising two (in number) sections, a said section to be attached on each side of said strip.

8. The sound attenuator as defined in claim 5 wherein said sound absorbing vane assembly further comprises:

an elongated bar mounted substantially at the longitudinal center-line of said duct, a plurality of supports projecting laterally from said bar and spaced longitudinally there along, a vane member twisted about said bar and mounted on said supports to lie along a helical path, said vane member being constructed of a sound absorbing material, said sound absorbing material including a soft fibrous mat.

9. The sound attenuator as defined in claim 8 wherein:

said vane member also including a thin sheet material strip of lead, said fibrous mat comprising two (in number) sections, a said section to be attached on each side of said strip.

* * * * *